United States Patent [19]

Cahill et al.

[11] Patent Number: 4,703,933

[45] Date of Patent: Nov. 3, 1987

[54] GAME PIECE OF FOLDABLE SHEET MATERIAL

[76] Inventors: James W. Cahill, 3262 Oakhill Dr., Troy, Mich. 48084; Budd H. Walker, 12212 Dividing Oaks Trail West, Jacksonville, Fla. 32223

[21] Appl. No.: 795,851

[22] Filed: Nov. 7, 1985

[51] Int. Cl.[4] ..... A63B 71/00; B42D 15/00

[52] U.S. Cl. ..... 273/139; 283/103; 283/105; 273/269

[58] Field of Search ..... 273/139, 269, 285, 286; 283/110, 105, 106, 103

[56] References Cited

U.S. PATENT DOCUMENTS

| | | | |
|---|---|---|---|
| 1,505,079 | 8/1924 | Mills | 283/105 |
| 3,512,780 | 5/1970 | Allison | 283/110 |
| 3,945,870 | 3/1976 | Johnsen | 156/201 |
| 3,956,049 | 5/1976 | Johnsen | 156/200 |
| 4,033,611 | 7/1977 | Johnsen | 283/6 |
| 4,074,911 | 2/1978 | Stipek, Jr. | 283/6 |
| 4,099,721 | 7/1978 | Longanaer | 273/139 |
| 4,241,942 | 12/1980 | Bachman | 283/6 |
| 4,299,637 | 11/1981 | Oberdeck et al. | 156/64 |

FOREIGN PATENT DOCUMENTS 1459343 12/1976 United Kingdom .

*Primary Examiner*—Richard C. Pinkham
*Assistant Examiner*—Gary Jackson
*Attorney, Agent, or Firm*—Basile & Hanlon

[57] ABSTRACT

A game piece formed of a strip of sheet material folded into a packet containing a plurality of overlaying panels. First and second panels of equal dimensions are connected along a common end edge by a perforated line. The second and third panels are separated by a fold line. Two perforated lines are formed on opposite sides of the fold line. Additional perforated lines are formed along the longitudinal edges of the first, second and third panels, as well as the outer end edge of the first panel. The third panel is folded over the second panel and the first panel is folded over the third panel after adhesive has been applied to the peripheral edges adjacent the longitudinal perforations and end perforations on the first panel to secure the first, second and third panels together into a closed form. Tearing of the overlaying perforations enables the first, second and third panels, each of which bears advertising or promotional indicia to be completely separated from each other for individual use.

3 Claims, 4 Drawing Figures

GAME PIECE OF FOLDABLE SHEET MATERIAL

BACKGROUND OF THE INVENTION

1. Field of the Invention

The present invention relates, in general, to coupons or tickets for advertising or promotional games and contests and more specifically, to coupons or tickets which include removable game pieces or markers used in the games.

2. Description of the Prior Art

Various types of games have been devised for promotional purposes which utilize tokens or markers which are passed out when a purchase is made at a store, gas station, etc. The tokens and markers are used to complete a puzzle or game card, such as a bingo card or used as redeemable tickets for prizes, money, etc.

Typically, the markers are enclosed in a coupon, ticket or game piece formed of a series of folded over sections, with the outer sections covering the marker from view until the game piece is opened. Most such coupons or game pieces include a series of perforated or weakened lines at various locations to enable the coupon or game piece to be opened by tearing along the perforated lines thereby exposing the interior of the game piece to view. The edges of the game pieces adjacent the perforated lines are fastened together by means of adhesive to hold the portions together in a sealed packet until opening.

However, previously devised game pieces utilize several folded over sections which are intended solely to cover the token or marker housed therein from view. Such overlaying sections have not been previously used to convey information or used themselves as game pieces, markers, coupons, etc.

Thus, it would be desirable to provide a game piece which makes use of all sections of the coupon or ticket. It would also be desirable to provide a game piece in which useful information may be contained on all portions of the folded over sections of the game piece. Finally, it would be desirable to provide a game piece which houses a token or marker for use in advertising or promotional games, as well as coupons for purchasing various goods at retail stores.

SUMMARY OF THE INVENTION

The present invention is a game piece which is utilized for various advertising or promotional games which utilize markers or tokens for completeing a game card, puzzle, etc, as well as providing an instant winning ticket. The game piece is formed of a strip of sheet material, such as paper, which is folded into a series of overlying panels. A number of perforated lines separate the various panels of the game piece to enable separation of each panel from the others for separate use. Adhesive is applied to selected edges of each panel to secure the panels together in an overlying manner. Preferably, one of the panels carries one or more game markers, while the adjacent two panels carry coupons for the purchase of various goods. Alternately, scratch-off panels and panels carrying ticket information may be deposited on any of the overlying panels.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
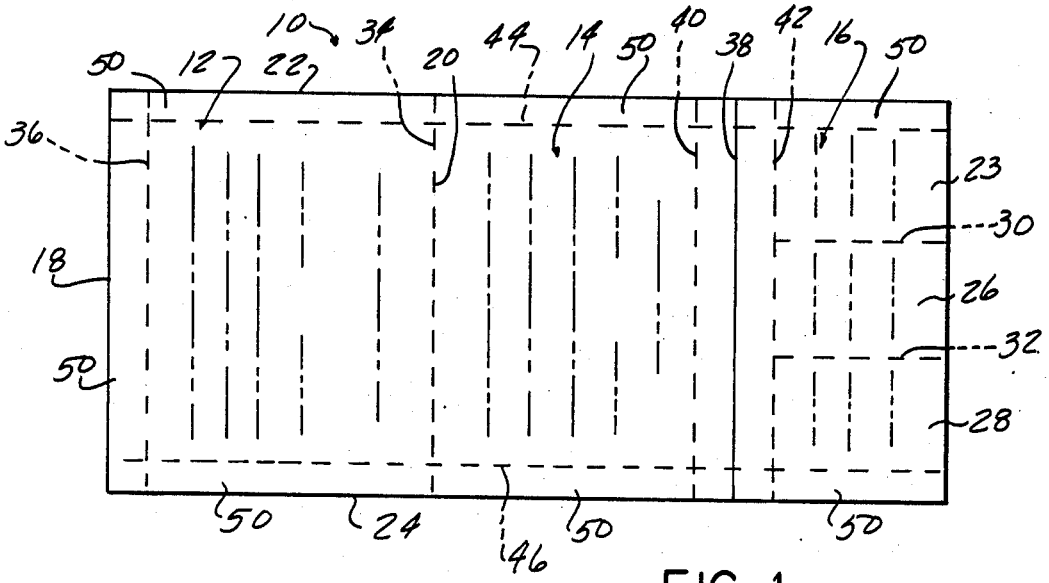
FIG. 1 is a plan view of a game piece constructed in accordance with the teachings of the present invention.

Throughout the following description and drawing, an idential reference number is used to refer to the same component shown in multiple figures of the drawing.

Referring to the drawing and to FIG. 1 in particular, there is illustrated a game piece 10 which is useable in advertising or promotional contests utilizing game tokens or markers for completing a puzzle, game board, as well as game pieces carrying product coupons, winning game number, etc.

Preferably, the game piece 10 is formed of a strip of sheet material of rectangular form. The sheet material can be formed of paper, cardboard, etc., which can be easily folded up into a number of overlying panels or sections.

As shown in FIG. 1, the game piece 10 includes first, second and third panels 12, 14 and 16, respectively. Although the panels 12, 14 and 16 may have any shape, it is preferred that they be substantially rectangular in form. Each of the panels, such as the first panel 12, is formed with end edges 18 and 20 and side edges 22 and 24.

It is preferred that the first and second panels 12 and 14 be of identical shape; while the third panel 16 is formed with a reduced width between the end edges 18 and 20. Also, each of the first, second and third panels 12, 14 and 16 are provided with substantially the same width as shown in FIG. 1; although panel 12 should be approximately 1/32 of an inch shorter than panel 14 to permit ease in printing indicia onto panels 12 and 14.

While the first and second panels 12 and 14 are illustrated as having a solid form, the third panel 16 is preferably divided into a series of individual sections which are useful as individual markers or tokens in the play of the game for which the game piece 10 is devised. Although any number of individual sections may be employed, preferably three sections, 23, 26 and 28 are provided on the third panel 16 and are separated by perforated or weakened tear lines 30 and 32, respectively.

Alternately, the third panel 16 may be formed as a single section, which may be tear-off and covered with a scratch-off material, etc., as described for the particular application of the game piece 10.

Additional perforated lines are also formed in the game piece 10 to enable opening of the game piece 10 after it has been formed into its folded over position as described hereafter. Thus, the first and second panels 12 and 14 are joined along adjoining end edges 18 and 20 by means of a perforated line 34. Another perforated line 36 is formed on the opposite end edge of the first panel 12.

The second and third panels 14 and 16 are separated by a fold line 38 to enable folding of the third panel 16 over the second panel 14 as described in greater detail hereafter. Additional perforated lines 40 and 42 are formed in the second and third panels 14 and 16, respectively, and are spaced equi-distantly on opposite sides of the fold line 38.

Longitudinally extending perforated lines 44 and 46 are formed adjacent the side edges 22 and 24 of the game piece 10 on each of the first, second and third panels 12, 14 and 16, respectively. The perforated lines 36, 44 and 46 form peripheral sections denoted by reference number 50 between the perforated lines and the outer peripheral edges of the game piece 10.

Adhesive is applied to these peripheral sections 50 prior to folding the game piece 10 into its compact packet form to secure the first, second and third panels 12, 14 and 16 into a secure packet.

Figure 2:
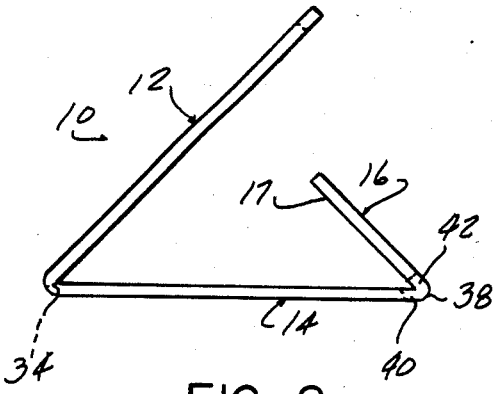
FIG. 2 is a side elevational view showing the method of folding up the game piece in FIG. 1.
Figure 3:
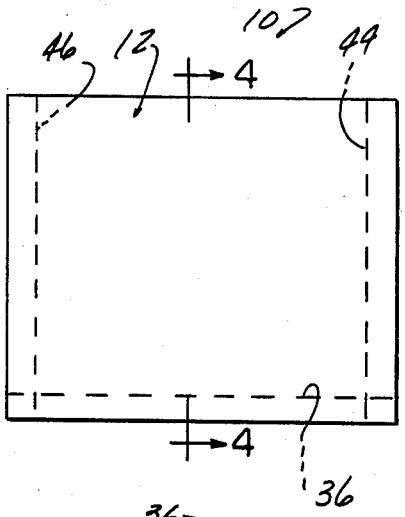
FIG. 3 is a plan view of a folded up game piece constructed in accordance with the teachings of the present invention.
Figure 4:
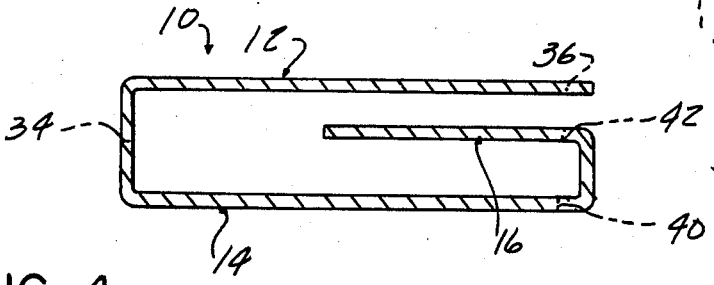
FIG. 4 is a cross sectional view generally taken along line 4—4 in FIG. 3.

As indicated above, the game piece 10 is foldable from its strip form into an overlapping packet. As shown in FIGS. 2, 3 and 4, the first step in forming the packet of the game piece 10 is achieved by folding the third panel 16 over the second panel 14 about the fold line 38. Once the third panel 16 has been brought into engagement with the second panel 14, the first panel 12 is then folded over the third panel 16 thereby blocking the entire third panel 16 and, in particular, the inside surface 17 from view until the game piece 10 is opened. The first panel 12 is folded about the perforated line 34 between the first panel 12 and the second panel 14. This forms a packet shown in FIGS. 3 and 4 in which the longitudinal perforations 44 and 46 on the first, second and third panels, 12, 14 and 16 are in overlaying alignment and the perforated lines 36, 40 and 42 in the first, second and third panels, 12, 14 and 16, are also aligned in an overlaying relationship. This enables the game piece 10 to be opened by ripping along the perforations 46, 44 and 36 thereby enabling the first, second and third panels 12, 14 and 16 to be spread open to the expanded planar form shown in FIG. 1.

The first and second panels 12 and 14 may then be separated about the perforated line 34 into two separate pieces. The act of tearing along the overlaying perforations 36, 40 and 42 automatically causes the third panel 16 to be separated fromt eh second panel 14. The individual sections 23, 26 and 28 of the third panel 16, if any, may be separated from each other by tearing along the perforations 30 and 32 located theebetween.

As noted above, the panels 12, 14 and 16 may have various printed indicia formed thereon. Thus, for example only, the first and second panels 12 and 14 may have product discount coupons material printed thereon; while the third panel, which may have any number of individual separable secitons, may be printed with game indicia, such as bingo members, etc., Alternatively any of the panels 12, 14 or 16 may be provided with scratch-off film coating covering any type of printed game or coupon matter.

The game piece of the present invention uniquely enables all of the various panels or secitons of a folded up, overlapping game piece or packet to be utilized for various advertising or promotional purposes. This enhances the advertising or promotional effect of the game piece since more than one advertising component is included in a single game piece.

What is claimed is:

1. A game piece formed of a strip of sheet material comprising:

first, second and third panels formed in the strip of sheet material;

the second panel being connected at one end edge to the first panel by a first perforated line;

the third panel being connected to the second panel at an opposed end edge by a fold line parallel to the first perforated line;

a second perforated line spaced inwardly from an opposite end edge to the first perforated line, the second perforated line defining a removable lateral border of the first panel;

third and fourth perforated lines spaced outwardly on opposite sides of the fold line between the second and third panels, the third and fourth perforated lines defining removable lateral borders of the second and third panels respectively;

fifth and sixth perforated lines spaced inwardly from opposite side edges of the first, second and third panels, the fifth and sixth perforated lines defining two removable longitudinal borders of the first, second and third panels;

the third panel foldable over the second panel along the folded line, wherein the lateral and longitudinal borders of the third panel overlie the lateral and longitudinal borders of the second panel;

the first panel foldable over the second and third panels along the first perforated line, whereint he lateral and longitudinal borders of the first panel overlie the lateral and longitudinal borders of the third and second panels respectively;

adhesive means applied to the lateral and longitudinal borders of the first, second and third panels to fasten the first, second and third panels together;

the second, third, fourth, fifth and sixth perforated lines enabling the lateral and longitudinal borders of the first, second and third panels to be removed, thereby disconnecting the third panel from the second panel and enabling the first panel to unfold to reveal opposing faces of the first and second panels.

the first perforated line enabling the first panel to be disconnected from the second panel; and one of the first, second and third panels comprising a plurality of separable sections connected by perforated lines defining separable sections of equal size and shape.

2. The game piece of claim 1, wherein the perforated lines connecting the separable sections of one of the panels are disposed parallel to the fifth and sixth perforated lines.

3. A game piece formed of a strip of sheet material comprising:

first, second and third panels formed in the strip of sheet material;

the first and second panels formed of equal size and shape and the third panel formed with a smaller longitudinal dimension than that of the first and second panels;

separate indicia formed on each of the first, second and third panels;

one of the panels further comprising a plurality of separable sections connected by perforated lines defining separable sections of equal size and shape;

the second panel being connected at one end edge to the first panel by a first perforated line;

the third panel being connected to the second panel at an opposed end edge by a fold line parallel to the first perforated line;

a second perforated line spaced inwardly from an opposite end edge to the first perforated line, said second perforated line defining a removable lateral border of the first panel;

third and fourth perforated lines spaced outwardly on opposite sides of the fold line between the second and third panels, the third and fourth perforated lines defining removable lateral borders of the second and third panels respectively;

fifth and sixth perforated lines spaced inwardly from opposite side edges of the first, second and third panels, the fifth and sixth perforated lines deining two removable longitudinal borders of the first, second and third panels;

the third panel foldable over the second panel along the fold line, wherein the lateral and longitudinal borders of the third panel overlie the lateral and longitudinal borders of the second panel;

the first panel foldable over the second and third panels along the first perforated line, wherein the lateral and longitudinal borders of the first panel overlie the lateral and longitudinal borders of the third and second panels respectively;

adhesive means applied to the lateral and longitudinal borders of the first, second and third panels to fasten the first, second and third panels together;

the second, third, fourth, fifth and sixth perforated lines enabling the lateral and longitudinal borders of the first, second and third panels to be removed, thereby disconnecting the third panel from the second panel and enabling the first panel to unfold to reveal opposing faces of the first and second panels;

the first perforated line enabling the first panel to be disconnected from the second panel; and the perforated lines connecting the separable sections of one of the panels disposed parallel to the fifth and sixth perforated lines.

* * * * *